US006722277B2

(12) United States Patent
Stephan

(10) Patent No.: US 6,722,277 B2
(45) Date of Patent: Apr. 20, 2004

(54) DEVICE FOR TURNING SHEET MATERIAL, PRINTING UNIT, AND MULTICOLOR ROTARY PRINTING PRESS

(75) Inventor: Günter Stephan, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/000,689

(22) Filed: Nov. 15, 2001

(65) Prior Publication Data

US 2002/0069773 A1 Jun. 13, 2002

(30) Foreign Application Priority Data

Nov. 15, 2000 (DE) ..... 100 58 720

(51) Int. Cl.[7] ..... B41F 21/00

(52) U.S. Cl. ..... 101/231; 101/142; 101/232; 101/409; 271/186; 271/309; 271/314

(58) Field of Search ..... 101/407.1, 409, 101/231, 232, 142; 271/65, 186, 309, 314

(56) References Cited

U.S. PATENT DOCUMENTS 3,341,195 A * 9/1967 Brandt et al. ..... 271/276
4,099,463 A * 7/1978 Zimmermann et al. ..... 101/230
4,395,949 A * 8/1983 Jeschke ..... 101/420
5,086,698 A * 2/1992 Wirz ..... 101/409
5,205,217 A * 4/1993 DeMoore et al. ..... 101/420
5,398,925 A * 3/1995 Zeltner ..... 271/276
5,598,779 A 2/1997 Haas et al.
5,816,155 A * 10/1998 Stephan ..... 101/232

FOREIGN PATENT DOCUMENTS

DE 41 40 762 A1 6/1993
DE 44 34 778 C1 11/1995
DE 44 24 967 C2 1/1996
DE 44 43 493 A1 6/1998

* cited by examiner

*Primary Examiner*—Daniel J. Colilla
*Assistant Examiner*—Jill E Culler
(74) *Attorney, Agent, or Firm*—Laurence A. Greenberg; Werner H. Stemer; Ralph E. Locher

(57) ABSTRACT

A device for turning sheet-like material from a printed side onto an unprinted side uses an impression cylinder which guides the sheet-like material and which is preceded by a transfer cylinder and followed by a further transfer cylinder. The sheet-like, flexurally rigid material is received on the outer surface of the impression cylinder and can be printed with a transmission cylinder. In the gusset between the outer surfaces of the impression cylinder and the preceding transfer cylinder, a contactlessly acting throw-on device is provided which forces the sheet-like material into a curved position corresponding to the curvature of the outer surface of the impression cylinder such that the sheet-like material is curved even in the gusset region. A printing press and a multicolor rotary printing press are also provided.

18 Claims, 7 Drawing Sheets

DEVICE FOR TURNING SHEET MATERIAL, PRINTING UNIT, AND MULTICOLOR ROTARY PRINTING PRESS

BACKGROUND OF THE INVENTION

FIELD OF THE INVENTION

The invention relates to a device for turning sheet-like material, a printing unit, a multicolor rotary printing press, and in particular to a storage device for turning a sheet-like material, such as is used, for example, on a turning device on rotary printing presses.

Published, Non-Prosecuted German Patent Application No. 41 40 762 A1 relates to a sheet guide device. This sheet guide device can be used selectively for recto and verso printing, and through the use of this sheet guide device the sheet can be turned, in recto and verso printing, according to the principle of the turning of the sheet trailing edge. Pneumatically operating devices and mechanical devices are provided under the impression cylinder preceding the turning drum. In order to provide a sheet guide device through the use of which sheets can be guided and led, free of smudges, in the turning phase, without a sheet bunch being formed, the impression cylinder is assigned a guide doctor blade which can be acted upon pneumatically at a given angle of inclination and which is provided with individual air outlet orifices. After the impression cylinder grippers have been opened, the printed sheet is released from the impression surface of the cylinder by blowing air, steered under the guide plate and, by the emerging blowing air, both held up and transported in the direction of the transfer cylinder, until the turning drum conveys the sheet further on.

German Patent No. 44 24 967 C2 relates to a method and a device for sheet turning. It proposes a method for sheet turning in sheet-fed rotary printing presses capable of being changed over from recto printing to recto and verso printing, according to the principle of trailing edge turning, in which, in recto and verso printing, a print carrier sheet guided on a cylinder is picked up by a pivotable sheet take-over system of a turning drum following the cylinder, at the tangent point of the turning drum and cylinder, by the trailing edge, and is transported further on. At the tangent point, the start of the print carrier sheet is released by the sheet grippers of the cylinder and, immediately after the tangent point, is guided on a path deviating from the surfaces of the cylinder under the turning drum.

The storage of sheet-like material on the impression cylinders of a rotary printing press requires free space underneath the impression cylinder, so that the sheet-like material can be received over its entire length. Thus, the sheet can be picked up and turned by the turning drum, without coming into contact with machine parts, casings of transfer drums, guide plates or other sheets. The space required for storage is contrary to the requirement for the sheet-like material to be printed out during transfer in the recto printing mode onto the transfer drum following the impression cylinder. The sheet-like material has already left the printing nip during transfer in recto printing. Consequently, in printing units with a single-drum turning device, a complete length of the maximum processable printing format must be provided as a freely available sheet transport zone in each case both between the transmission cylinder and the central gripper assembly to a following transfer drum and between the following transfer drum and the central transfer assembly to the preceding transfer drum, the space for the collision of the fittings provided there being taken into account. Furthermore, the necessary space requirement for accessibility and for fittings upstream of the printing nip must also be taken into account.

A further possibility for solving the technical problem described is to pivot the configuration of the cylinders to an extent such that the construction space for printing out and for storage is gained at the expense of the fittings upstream of the printing nip. This measure is detrimental to the quality of sheet guidance upstream of the printing nip, so that the print quality obtained is poorer. Moreover, there is a fear of serious effects on the accessibility of the fittings. This makes it more difficult to clean, to carry out adjustments and to perform servicing during maintenance work.

A further remedial possibility is to restrict the permissible print carriers for the recto and verso printing mode to those papers which remain adhering to the circumference of the impression cylinder and do not move away from the impression cylinder as a result of a gravitational influence and flexural rigidity. Through the use of this measure the collision space to be kept free could be restricted and the permissible format length increased. The restriction to only some permissible print carriers for rotary printing presses with turning devices is seriously detrimental to the processable print carriers and can only be a compromise solution.

SUMMARY OF THE INVENTION

It is accordingly an object of the invention to provide a device for turning sheet material which overcomes the above-mentioned disadvantages of the heretofore-known devices of this general type and with which on the one hand, the format length of the sheet can be printed out completely and, on the other hand, the sheet-like material can be stored, completely free of collision, in the recto and verso printing mode, with the cylinder rolling conditions being maintained.

With the foregoing and other objects in view there is provided, in accordance with the invention, a device for turning sheet material, including:

- an impression cylinder having an outer surface with a given curvature, the impression cylinder being configured to guide a sheet material received on the outer surface of the impression cylinder;
- a first transfer cylinder preceding the impressing cylinder, the first transfer cylinder having an outer surface;
- the impression cylinder and the first transfer cylinder defining a gusset region between the outer surface of the impression cylinder and the outer surface of the first transfer cylinder;
- a second transfer cylinder following the impression cylinder; and
- a throw-on device provided in the gusset region, the throw-on device contactlessly acting on the sheet material and causing the sheet material to assume, instead of a stretched position, a curved position corresponding to the given curvature of the outer surface of the impression cylinder such that a part of the sheet material is disposed in the gusset region.

In other words, according to the invention, a device for the turning of sheet-like material by use of a cylinder which guides sheet-like material and which is preceded by a transfer cylinder and followed by a transfer cylinder, the sheet-like material received on the outer surface of the impression cylinder being capable of being printed by a transmission cylinder, wherein, in the gusset of the outer surfaces between the impression cylinder and the preceding transfer drum, a contactlessly acting throw-on device is provided, which causes the sheet-like material to assume, instead of a stretched position, a curved position corresponding to the given curvature of the outer surface of the impression cylinder, with the gusset region being included.

Through the use of the throw-on device, configured and provided according to the invention, for the contactless holding of sheet-like, even relatively flexurally rigid sheet-like material, such as cardboard, the sheet-like material can be curved, free of smudges, onto the impression cylinder, so that no collisions of the ends of the sheet-like material, in particular when the latter assumes the stretched position, with fittings provided underneath the cylinders guiding sheet-like material and with the outer surface of the cylinders guiding the sheet-like material can occur. Through the use of the throw-on device proposed according to the invention, the tendency of relatively flexurally rigid sheet-like material, such as cardboard, to stretch out straight from a curved position can be counteracted. Through the use of the throw-on device proposed according to the invention, the involute peeling-off movement of the relatively flexurally rigid material away from the outer surface of the impression cylinder can be prevented. The fluid, for example blowing air, emerging from the contactlessly acting throw-on device is directed onto that region of the sheet-like material, such as paper or even relatively flexurally rigid cardboard, which is located just upstream of its trailing edge. The fluid emerging out of the throw-on device from outlet orifices includes at least one flow component which is directed perpendicularly to the desired position of the sheet-like material, that is to say points perpendicularly to the surface of the impression cylinder.

In an advantageous embodiment according to the invention, the contactlessly acting throw-on device generates, on the rear region of the sheet-like material, a force component which acts perpendicularly on the curved outer surface of the impression cylinder. What can be achieved thereby is that the rear end of the sheet-like material does not come to bear in its stretched position onto that outer surface of the impression cylinder which is located in the gusset region, but, instead, an additional length gain being produced.

The throw-on device may advantageously contain orifices, from which emerges a fluid, for example blowing air, in the form of free jets which have at least one flow component directed perpendicularly to the outer surface of the impression cylinder. The orifices may be formed on the contactlessly acting throw-on device either next to one another, one behind the other or in any other desired sequences. It is critical that a sufficient volume of a fluid can emerge through the orifices which generates the throw-on force acting perpendicularly to the outer surface of the impression cylinder.

In a first variant according to the invention, the throw-on device may be configured as a blowpipe embedded into the gusset region of outer surfaces of the preceding transfer cylinder and impression cylinder. The blowpipe may be positioned in a clearance between the outer surface of the preceding transfer cylinder and the sheet edge when the sheet-like material is in the stretched position.

In a further variant according to the invention, the contactlessly acting throw-on device can be integrated into a sheet guide device which is assigned to a preceding transfer cylinder. Consequently, the necessary construction space can be kept small and a fluid flow can be generated which lies as far as possible into the region of the central transfer point or transfer region between the preceding transfer cylinder and impression cylinder. The maximum format length of even relatively flexurally rigid material can thereby be widened, for turning, in such a way that the sheet end reaches almost as far as the central transfer point, without the risk of collision with the following sheet just being transported into the printing nip by the transfer drum and therefore without the risk of smudging.

According to another feature of the invention, the throw-on device acting contactlessly on the rear region of the sheet-like material includes outlet orifices, from which the medium generating the throw-on force emerges in such a way that the sheet edge of the sheet-like material is laid onto the outer surface of the impression cylinder with additional bearing contact, that is to say so as to achieve a curvature length gain, as far as below the central transfer point. The contactlessly acting throw-on device may advantageously be assigned a guide device which extends from a central transfer point between the outer surfaces of an impression cylinder and of a preceding transfer cylinder below the printing-unit cylinder as far as a further printing-unit cylinder or impression cylinder.

According to another feature of the invention, the guide device assigned to the contactlessly acting throw-on device may be formed in a curvature which is matched to the shape, precurved by the throw-on device, of the sheet-like material.

According to yet another feature of the invention, the guide device may be formed of individual rod-like or bar-shaped elements spaced from one another and preferably configured as round bars.

According to a further feature of the invention, the guide device may be configured as a continuous; in particular curved, guide plate.

In order to utilize the effectiveness of the throw-on device acting contactlessly on the rear region of relatively flexurally rigid sheet-like material for all formats which can be processed on a rotary printing press, the contactlessly acting throw-on device can be adapted, within an adjustment travel, to the sheet-like material to be processed in each case in the rotary printing press.

Particularly good gains in curvature length with regard to the bearing of the sheet-like material onto the outer surface of the impression cylinder are achieved when outlet orifices are provided at the upper end of the contactlessly acting throw-on devices, for free jets which flush separating air in between the printed side of the sheet-like material on the impression cylinder and the sheet on the transfer cylinder preceding the latter. It is thereby possible to prevent the still unprinted surface of the following sheet from adhering to the already printed outward-facing surface of the sheet-like material printed on one side.

On that side of the contactlessly acting throw-on device which faces the outer surface of the impression cylinder, outlet orifices can be provided, through which the free jets generating the holding force can be guided, in order to produce a curvature length gain, into the gusset region between the impression cylinder guiding the sheet-like material and the transfer cylinder preceding the impression cylinder.

According to another feature of the invention, a transmission cylinder is provided adjacent to the impression cylinder for printing onto the sheet material.

The device, proposed according to the invention, for allowing collision-free turning of even relatively flexurally rigid sheet-like material can be used preferably in printing units of sheet-processing rotary printing presses configured as an inline construction, in particular on multicolor rotary printing presses, in which a sheet turning device is received.

With the objects of the invention in view there is therefore also provided a printing unit, including:

a turning device for turning a sheet material, the turning device including an impression cylinder having an outer surface with a given curvature, the impression cylinder being configured to guide the sheet material received on the outer surface of the impression cylinder, a first transfer cylinder preceding the impressing cylinder, the first transfer cylinder having an outer surface, the impression cylinder and the first transfer cylinder defining a gusset region between the outer surface of the impression cylinder and the outer surface of the first transfer cylinder, a second transfer cylinder following the impression cylinder, and a contactlessly acting throw-on device provided in the gusset region, the throw-on device causing the sheet material to assume, instead of a stretched position, a curved position corresponding to the given curvature of the outer surface of the impression cylinder such that a part of the sheet material is disposed in the gusset region; and a transmission cylinder provided adjacent to the impression cylinder for printing onto the sheet material.

With the objects of the invention in view there is further provided a multicolor rotary printing press, including:

a turning device for turning a sheet material from a printed side onto a side to be printed, the turning device including an impression cylinder having an outer surface with a given curvature, the impression cylinder being configured to guide the sheet material received on the outer surface of the impression cylinder, a first transfer cylinder preceding the impressing cylinder, the first transfer cylinder having an outer surface, the impression cylinder and the first transfer cylinder defining a gusset region between the outer surface of the impression cylinder and the outer surface of the first transfer cylinder, a second transfer cylinder following the impression cylinder, and a contactlessly acting throw-on device provided in the gusset region, the throw-on device causing the sheet material to assume, instead of a stretched position, a curved position corresponding to the given curvature of the outer surface of the impression cylinder such that a part of the sheet material is disposed in the gusset region; and a transmission cylinder provided adjacent to the impression cylinder for printing onto the sheet material.

Other features which are considered as characteristic for the invention are set forth in the appended claims.

Although the invention is illustrated and described herein as embodied in a storage device for the turning of sheet-like material, it is nevertheless not intended to be limited to the details shown, since various modifications and structural changes may be made therein without departing from the spirit of the invention and within the scope and range of equivalents of the claims.

The construction and method of operation of the invention, however, together with additional object's and advantages thereof will be best understood from the following description of specific embodiments when read in connection with the accompanying drawings.

DESCRIPTION OF THE PREFERRED EMBODIMENTS

Figure 1:
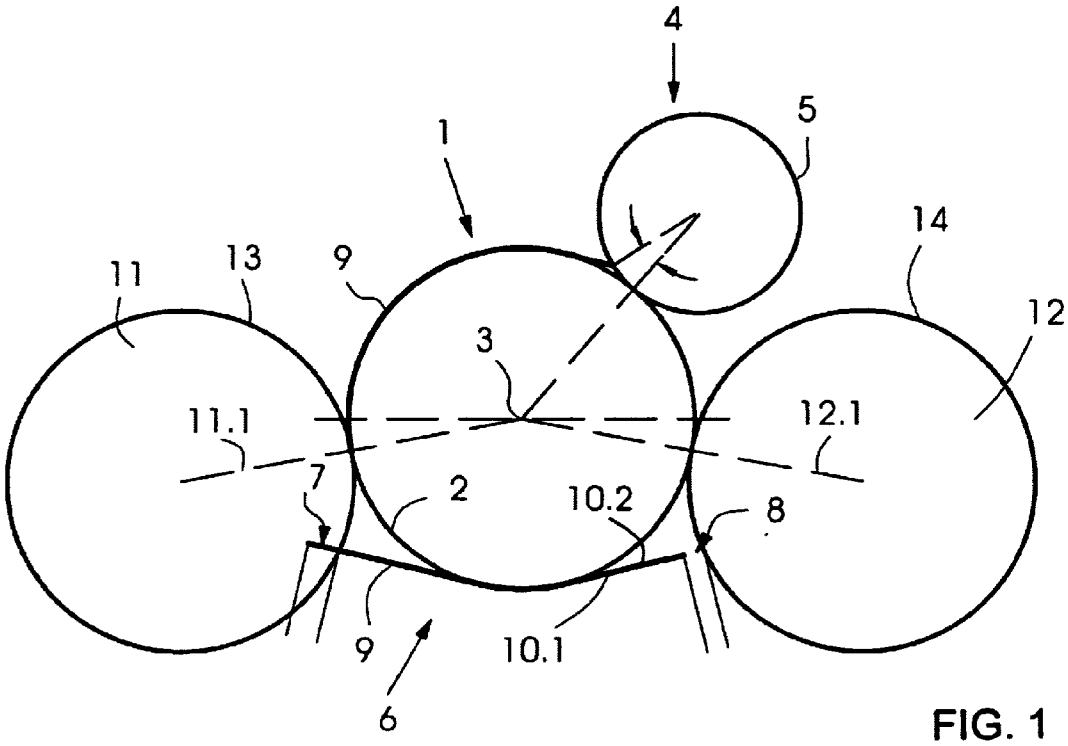
FIG. 1 is a diagrammatic side-elevational view of the cylinder configuration of a rotary printing press with a transfer cylinder preceding an impression cylinder and with a transfer cylinder following the impression cylinder.

Referring now to the figures of the drawings in detail and first, particularly, to FIG. 1 thereof, there is shown a cylinder configuration of a rotary printing press, with a transfer cylinder preceding an impression cylinder and with a transfer cylinder following the latter.

An impression cylinder 1, on the outer surface 2 of which sheet-like material 9, be it paper or relatively flexurally rigid cardboard, is guided, is assigned, on the one hand, a transmission cylinder 4 and two transfer cylinders 11 and 12. The axes of rotation of the two transfer cylinders 11 and 12 lie slightly below the axis of rotation 3 of the impression cylinder 1. Central transfer points, designated by the reference symbols 11.1 and 12.1, are marked between the respective axes of rotation of the transfer cylinder 12 preceding the impression cylinder 1 and between the axis of rotation 3 and the axis of rotation of the transfer cylinder following the impression cylinder 1. The central transfer points 11.1 and 12.1 mark the points at which the sheet-like material goes from the outer surface 14 of the transfer cylinder 12 preceding the impression cylinder 1 over onto the outer surface 2 of the impression cylinder 1 or the location at which the sheet-like material 9 goes over from the outer surface 2 of the impression cylinder 1 to the outer surface 13 of the transfer cylinder 11 following the impression cylinder 1. In the illustration according to FIG. 1, a storage device 6, illustrated merely diagrammatically here, which receives the sheet-like material 9, is located below the impression cylinder 1 between the transfer cylinders 11 and 12. In the state illustrated in FIG. 1, the sheet-like material is positioned with its printed side 10.1 on the outside, while the unprinted side 10.2 of the sheet-like material 9 faces the outer surface 2 of the impression cylinder 1. Reference symbol 7 designates the distance at which the former edge of the sheet-like material 9 to be turned, now the new sheet leading edge, is taken over in gripping devices, not illustrated in any more detail here, of the transfer cylinder 11 following the impression cylinder 1.

Figure 2:
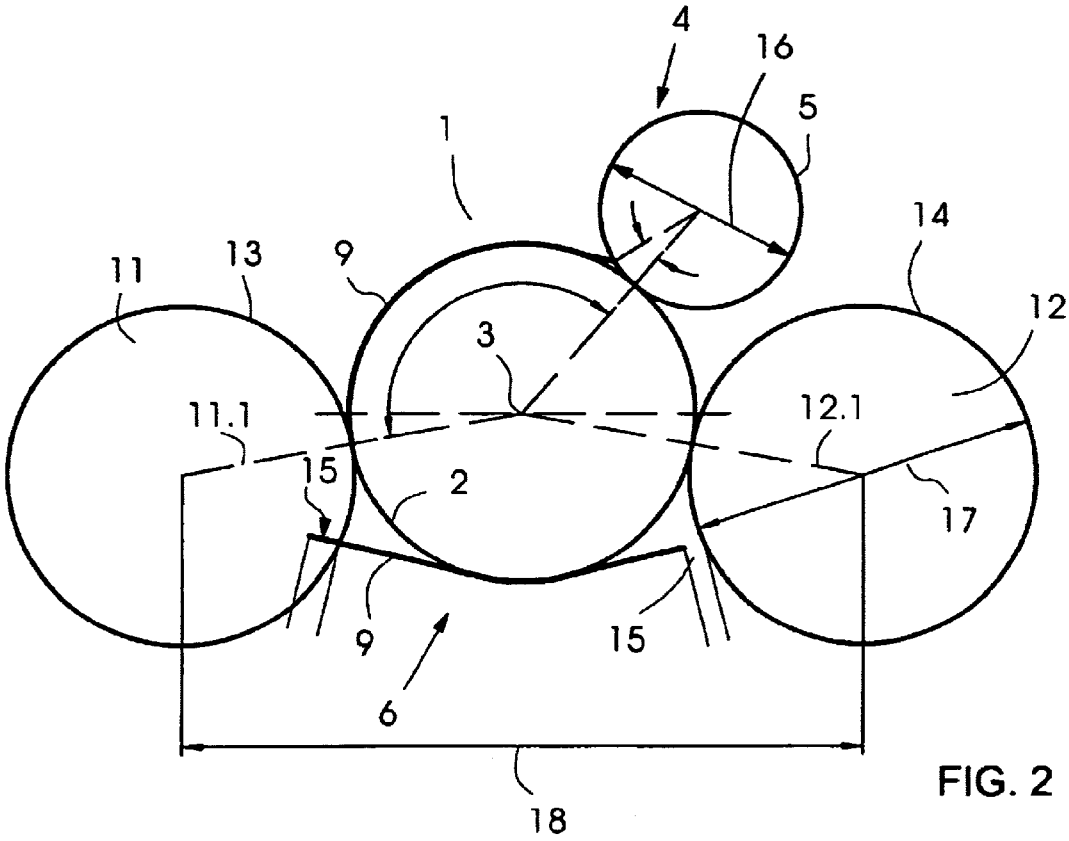
FIG. 2 is a diagrammatic side-elevational view of the cylinder configuration of a rotary printing press according to FIG. 1, with slightly varying safety distances between the outer surfaces and the respective ends of the maximum processable format of the sheet-like material.

A cylinder configuration, constructed essentially analog to the illustration of FIG. 1, of a printing unit of a rotary printing press with a sheet turning device is shown in FIG. 2.

In contrast to the illustration according to FIG. 1, the sheet-like material 9 surrounded by the storage device 6 is positioned below the impression cylinder 1 at approximately identical distances 15 with respect to the edges of the sheet-like material 9. The transmission cylinder 4 having an outer surface 5 is provided with a diameter 16 which corresponds to half the diameter 17 with which both the preceding transfer cylinder 12, the impression cylinder 1 and the following transfer cylinder 11 are provided. Due to these cylinder rolling conditions, it is possible, as shown in the illustration according to FIG. 1 or FIG. 2, to receive the sheet-like material 9, supported by the storage device 6, below the circumference of the outer surface, that is to say on the outer surface 2 of the impression cylinder 1. Reference symbol 18 designates the distance between the axes of rotation of the transfer cylinders 11 and 12, that is to say the length of a printing unit of a rotary or multicolor rotary printing press. The distance 15, at which the sheet-like material 9 penetrates into the outer surface 13 of the following sheet-guiding transfer cylinder, identifies the region in which the former trailing edge of the sheet-like material, that is to say now the new sheet leading edge of the sheet-like material as a result of turning, is gripped by gripping devices of the transfer cylinder 11 following the impression cylinder 1 and is transported further on.

The illustration according to FIG. 3 reveals in more detail the curvature position of the sheet-like material and its stretched position in the transfer region below a central transfer point of two cooperating rotating cylinders guiding sheet-like material.

The impression cylinder 1 rotating about its axis of rotation 3, moves counterclockwise in the direction of rotation 28. The outer surface 2 of the impression cylinder 1 and the path of the sheet-holding gripper system of the transfer cylinder 12 preceding the impression cylinder 1 form, in the region of the central transfer point 12.1, the transfer location at which the sheet-like material 9 goes over from the outer surface 14 of the preceding transfer cylinder 12 onto the outer surface 2 of the impression cylinder 1.

Figure 3:
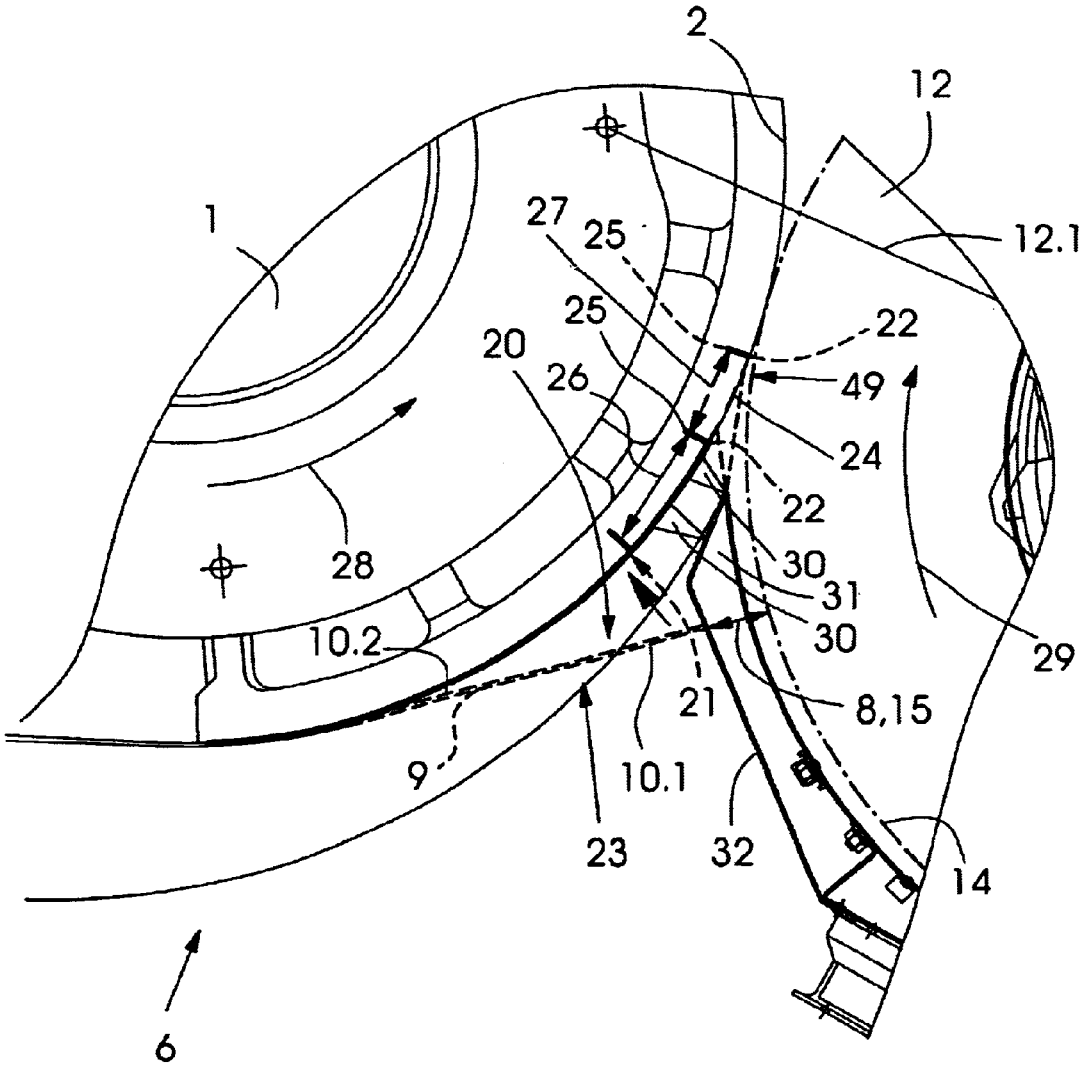
FIG. 3 is a partial, diagrammatic sectional view of a cylinder configuration for illustrating the curving of sheet-like material out of its stretched position into a curved bearing contact through the use of fluid emerging from a guide device according to the invention.

Provided below the outer surfaces 2, 14 of the cylinders cooperating with one another according to FIG. 3 are a storage device 6 and a guide device 32, 34 which contain a common region at the throw-on device 31. A throw-on device acting contactlessly on the sheet-like material 9 is provided in the common region at the throw-on device 31. The guide device 6 may be configured, for example, as a continuous guide plate or by a plurality of round bars which are provided next to and at a distance from one another and which are matched in their curvature to the curvature position 19 of the sheet-like material 9 on the outer surface 2 of the impression cylinder 1. The throw-on device 31 is provided in such a way that it covers the safety clearance of approximately 30 mm designated by reference symbols 8 and 15. A gusset region is indicated by reference numeral 49.

Broken lines show a stretched position 23 of a flexurally rigid sheet-like material 9 which with its unprinted side 10.2 faces the outer surface 2 of the impression cylinder 1. The printed side 10.1 of the sheet-like material 1 faces the storage or guide device 6. As a result of the flexural rigidity inherent in relatively flexurally rigid materials, such as, for example, cardboard, these tend, in addition to a vertically downward-directed acceleration caused by gravity, to stretch out straight from a curvature position 19. The old leading edge 22 leaving the gripper, that is to say the new trailing edge, thereby moves away from the impression cylinder circumference 2 in an involute manner. The opening region occurring during this peeling-off action is marked by reference symbol 20. If, then, during the decelerated entry of the already precurved sheet-like relatively flexurally rigid material 9, the throw-on device 31 acting contactlessly according to the invention acts, according to FIG. 3, on the rear region of the sheet-like material 9, the rear region can be bent in such a way that its unprinted side 10.2 comes to bear onto the outer surface 2 of the impression cylinder 1. The curvature position of the sheet-like relatively flexurally rigid material 9 which comes to bear is designated by reference symbol 19 or, in the upper region, by reference symbol 24. Reference numeral 21 indicates a new trailing edge of a sheet. The configuration of the throw-on device 31 makes it possible to produce a length gain 26 or, in the case of optimization, a further additional storage region 27 on the outer surface 2 of the impression cylinder 1, in which region free jets 30 emerge from the throw-on device 31 configured triangularly in the upper region. The free jets 30 generate a force directed perpendicularly to the outer surface 2 of the impression cylinder 1, so that the sheet-like material 9 comes to bear onto the outer surface 2 of the impression cylinder 1 within the region 26 and ideally within the region 27. The sooner the throw-on force generated by the free jets 30 acts on the rear region of the sheet-like material 9 during its deceleration phase, the more advantageously does the unprinted side 10.2 come to bear onto the outer surface 2 of the impression cylinder 1, that is to say the more the storage potential 27 can be utilized in order to store relatively flexurally rigid sheet-like material 9 on the outer surface 2 in the lower region of the impression cylinder 1.

Figure 4:
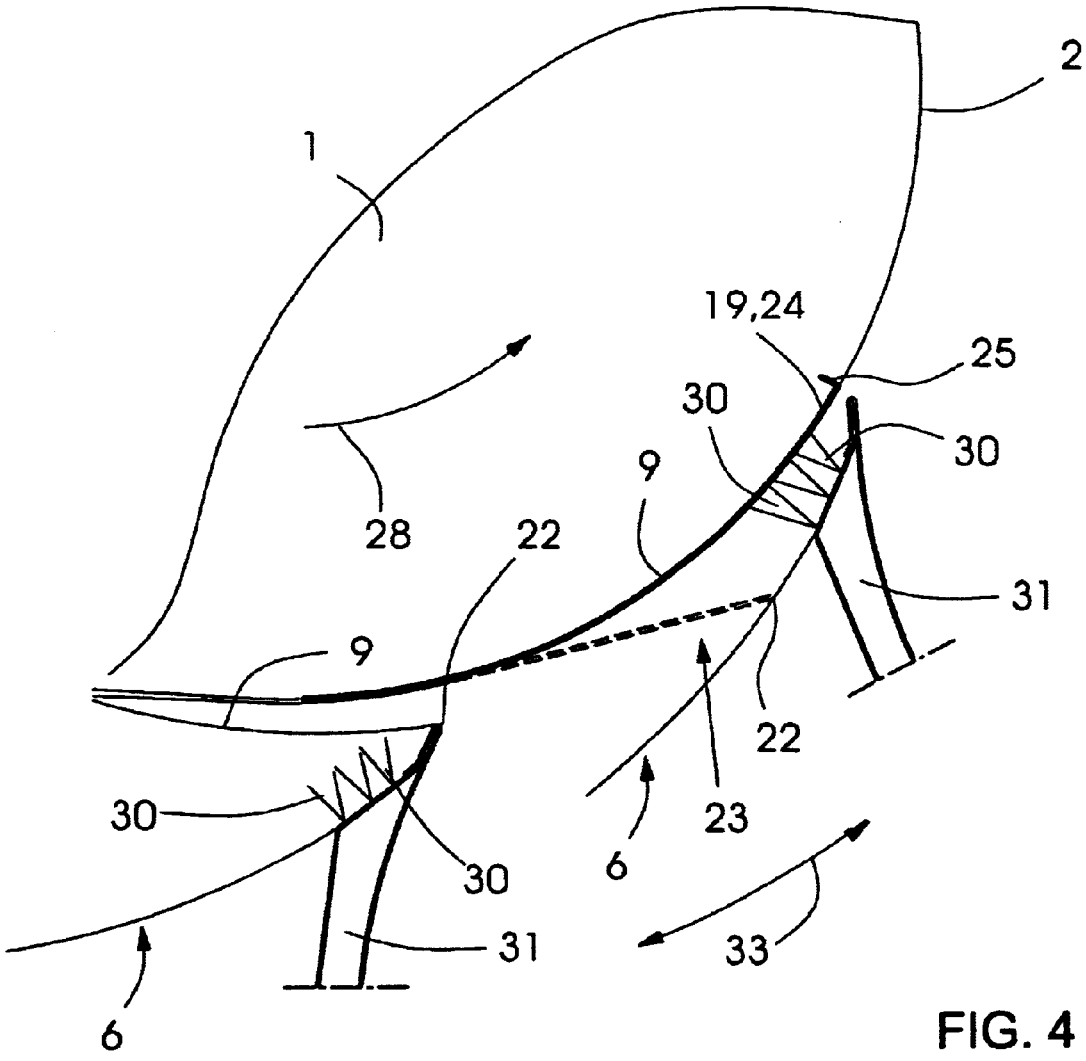
FIGS. 4, 4A, and 4B are partial, diagrammatic sectional views of cylinder configurations with an adjustable-format guide device with blowing-air outlet orifices according to the invention.
Figure 4A:
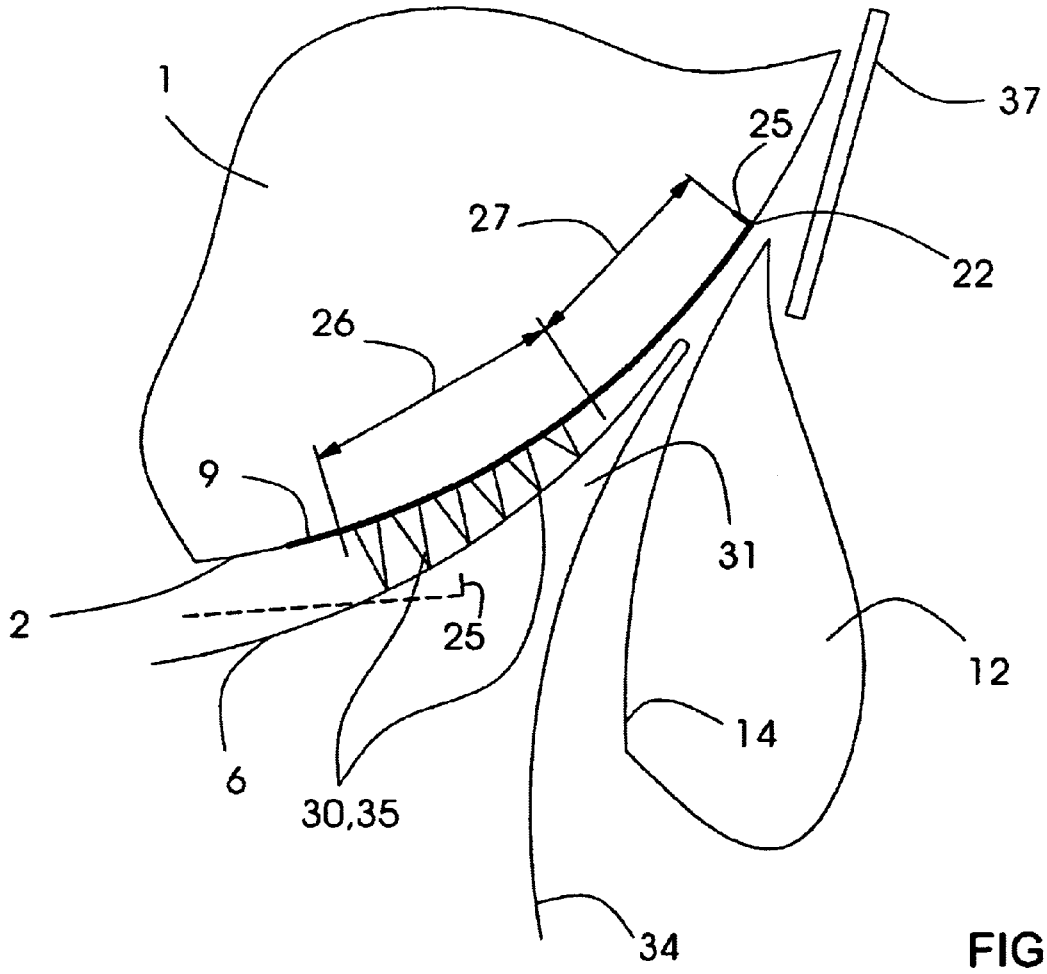
Figure 4B:
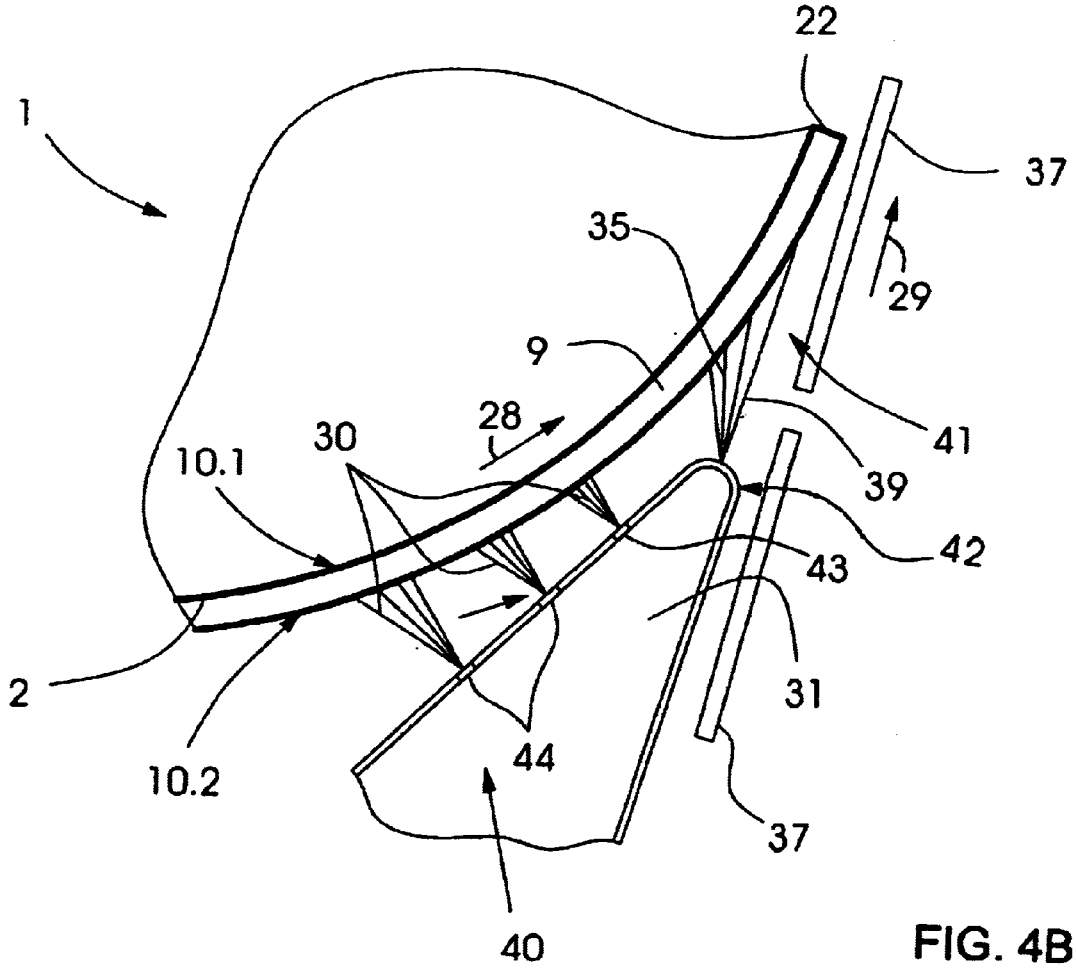

An adjustable-format throw-on device and details of this may be gathered in more detail from FIGS. 4 to 4B. Since different sheet formats can be processed on rotary printing presses processing sheet-like material 9, care must be taken to adapt the throw-on device 31, acting contactlessly on the rear region of the sheet-like material 9, to the format length to be processed in each case. This is carried out by the guide device 31 being moveable, within a format-dependent adjustment travel 33, below the cylinder 1 guiding the sheet-like material 9 onto its outer surface 2. The format-dependent adjustment travel 33 is selected such that the throw-on device 31 acting contactlessly on the rear region of the sheet-like material 9 covers both the minimum processable and the maximum processable format. Through the use of the storage or guide device 6, which extends from the throw-on device 31 and which may be configured as a round-bar configuration or as a continuous surface, the sheet-like material 9 to be decelerated and turned is precurved and experiences physical contact, if at all, only at its sheet edge 22 with the guide or storage device 6. During the counterclockwise rotation of the impression cylinder in the direction 28, the sheet-like material 9 is transferred into a curvature position 19 or 24 or is held so as to remain in a curvature position, thus counteracting the tendency to assume a stretched position 23, so that the sheet edge 22 of the sheet-like material 9 lies, at the bearing location 25, on the outer surface 2 of the impression cylinder 1. This is produced by a multiplicity of free jets emerging from that side of the throw-on device 31 which is located opposite the outer surface 2 of the impression cylinder 1.

In the embodiment illustrated in FIG. 4, the flow component of the free jets is directed such that it runs perpendicularly to the outer surface 2 of the impression cylinder 1. This results, as a function of the set volume of the free jets or of the outlet velocity, in throw-on forces which transfer even relatively flexurally rigid sheet-like material 9, for example cardboard, into the curved position 19, 24 which corresponds to the curvature of the outer surface 2 of the impression cylinder 1.

FIG. 4A shows, on an enlarged scale, the contactlessly acting throw-on device 31 configured according to the invention. The essentially triangular configured throw-on device 31 may be configured preferably as part of a guide device 32, 34 which is assigned to the transfer cylinder 12 preceding the impression cylinder 1. In the region of the central transfer point 12.1, the transfer cylinder 12 preceding the impression cylinder 1 and the impression cylinder 1 form the transfer location at which the sheet-like material 9 goes over from the outer surface 14 onto the outer surface 2 of the impression cylinder 1. Due to the narrowing nip between the storage or guide device 6 and the outer surface 2 of the impression cylinder 1, the sheet-like material experiences a precurvature which is ultimately reinforced by the action of the free jets 30 or 35 emerging from the lateral surface of the contactlessly acting throw-on device 31. The rear region of the sheet-like material 9 can thereby come to bear on the outer surface 2 of the impression cylinder 1 in the regions 26 and 27, so that the bearing location 25 of the sheet trailing edge 22 of a relatively flexurally rigid sheet-like material 9 can be placed almost as far as the central transfer point 12.1 between the preceding transfer cylinder 12 and the impression cylinder 1. As a result, contact of the printed-out sheet trailing edge 22 with the surface of a following sheet 37, indicated merely diagrammatically here in FIG. 4A, or of its unprinted top side can be avoided effectively.

The illustration according to FIG. 4B reveals in more detail that region of the contactlessly acting throw-on device 31 which projects into the gusset between the two cylinders cooperating with one another.

The upper end 42 of the throw-on device acting contactlessly on the sheet-like material 9 is provided with an extremely sharp radius. Provided at this is an outlet orifice 44, through which emerges, according to the illustration of FIG. 4B, a free jet 35 providing an air stream 39 which serves as separating air 41 between the top side of the following sheet 37 and the printed underside 10.2 of the sheet-like material 9 received on the outer surface 2 of the impression cylinder 1. Through the use of the separating air, between the following sheet 37 and the printed side 10.2 of the relatively flexurally rigid sheet-like material 9, an air cushion is produced, which prevents contact between these two copy sheets moved relative to one another. On the obliquely inclined side of the contactlessly acting throw-on device 31 which uses air 41 and which merges into a storage or guide device 6 (cf. the illustration in FIGS. 4A and 4), outlet orifices 43 are provided, which may be configured, for example, as nozzles 45. An appropriate blowing-air volume emerges from these, in the form of free jets 30 which have at least one flow component directed perpendicularly to the outer surface 2 of the impression cylinder 1. The rear region of the relatively flexurally rigid sheet-like material 9 is thereby thrown with its unprinted side 10.1 onto the outer surface 2 of the impression cylinder 1, so that the gusset region occurring between the outer surfaces 14 and 2 of the cylinders cooperating with one another can be utilized, during the turning of the relatively flexurally rigid sheet-like material 9, as storage space for receiving the latter. While the free jets 35 emerging at the upper end 42 from the throw-on device acting contactlessly on the sheet-like material 9 serve as separating air 41, the volumes of air 40 emerging from the orifices 43 and 45 can be characterized more accurately as free jets 30 generating holding air or holding forces. Their main task is primarily to prevent relatively flexurally rigid sheet-like material 9 from coming into contact with the following sheet 37 and with other fitting elements and the throw-on device 31 itself during the reversal in direction of movement, that is to say also for the resting phase of the sheet-like material 9 in the storage device 6.

Figure 5:
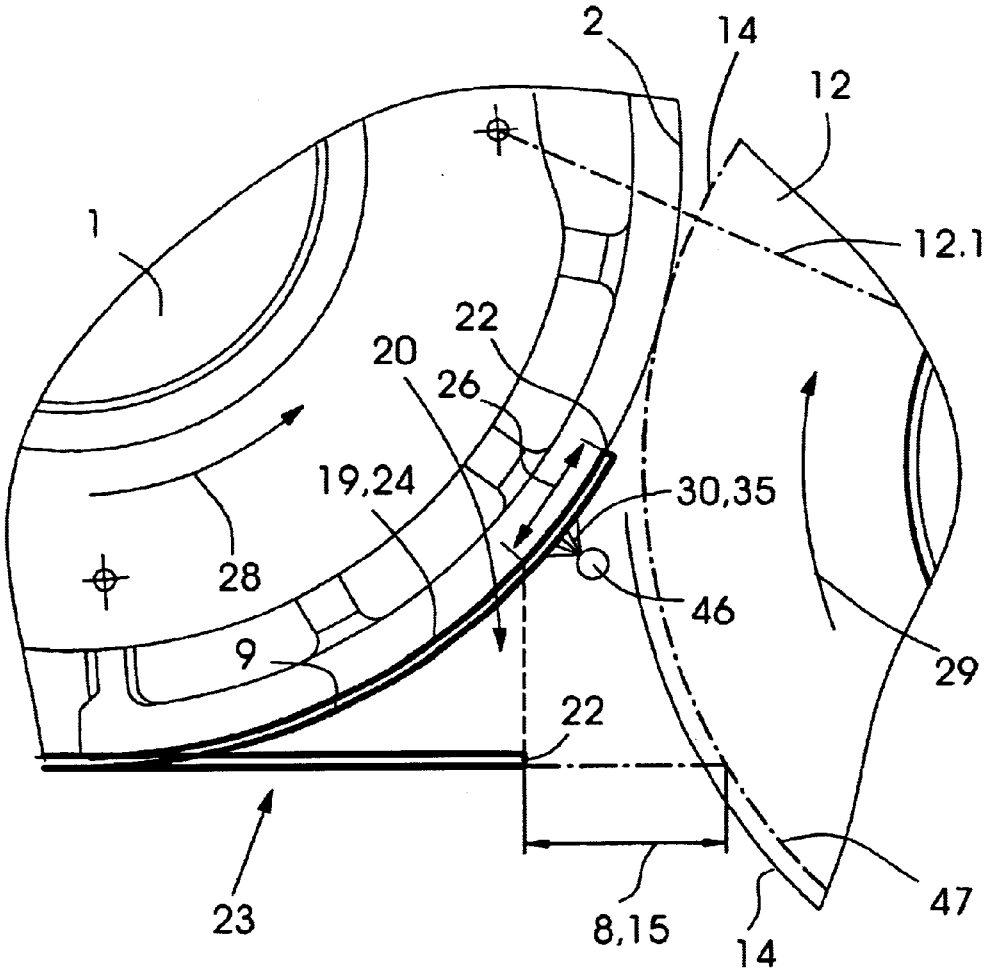
FIG. 5 is a partial, diagrammatic sectional view of a throw-on device according to the invention which is configured as an individual blowpipe and is provided in the cylinder gusset.

The illustration according to FIG. 5 shows an individual blowpipe which functions as a contactlessly acting throw-on device. Here, too, a contactlessly acting holding device in the form of a blowpipe 46 is embedded in the gusset region of two sheet-guiding cylinders 2 and 12 cooperating with one another. A bundle of free jets 30 and 35 emerges from this blowpipe and transfers relatively flexurally rigid sheet-like material 9 into a curvature position 19 or 24 corresponding to the curvature of the outer surface 2 of the impression cylinder 1, so as to counteract the tendency of the sheet-like material 9 to assume a stretched position 23. The individual blowpipe 46 is provided preferably as far as possible into the gusset region below the central transfer point 12.1 between the impression cylinder 1 and the transfer cylinder 12 preceding the latter. The preceding transfer cylinder 12 rotates clockwise 29 about its axis of rotation, while the impression cylinder 1 rotates counterclockwise in the direction of the arrow 28. The storage space which can be achieved additionally in the gusset region between the outer surfaces 2 and 14 is characterized by reference symbols 26 and 27, that is to say the region in which a curvature 19 or 24 can be imparted to the rear region of the sheet-like relatively flexurally rigid material 9 by throw-on forces being generated. Reference symbol 20 identifies the free space which the sheet would assume when it moves out into its stretched position 23 by virtue of the inherent flexural rigidity. The sheet edge 22 lies at the distance 8 or 15 (approximately 30 mm) from a gripper path 47 which indicates here, merely diagrammatically, the path which gripper systems describe when the transfer cylinder 12 preceding the impression cylinder 1 rotates clockwise 29.

Figure 6:
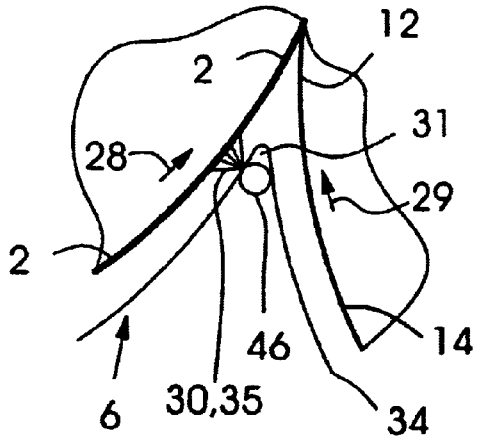
FIG. 6 is a partial, diagrammatic sectional view of a cylinder configuration with a blowpipe which is integrated into a guide device for sheet-like material according to the invention.

The illustration according to FIG. 6 shows a blowpipe which is integrated into a guide device for sheet-like material.

It may be gathered from this configuration, reproduced merely diagrammatically here, that, instead of a plurality of orifices 43, 44 or nozzles 45 in the lateral surfaces of a throw-on device 31, a blowpipe 46 according to the illustration in FIG. 5 can be integrated into the gusset between the two cylinders 2 and 12 cooperating with one another. Free jets 30 and 35 emerge from the blowpipe at orifices on the circumferential surface of the latter and make it possible for sheet-like material 9 which is relatively flexurally rigid, for example cardboard, to fit snugly onto the outer surface 2 of the impression cylinder 1. In a preferred configuration possibility, the throw-on device 31 rising in the form of a dome may be part of a guide device 34 which is assigned to the preceding transfer cylinder and which, in turn, merges into the storage or guide device 6 received below the impression cylinder 1.

Figure 7:
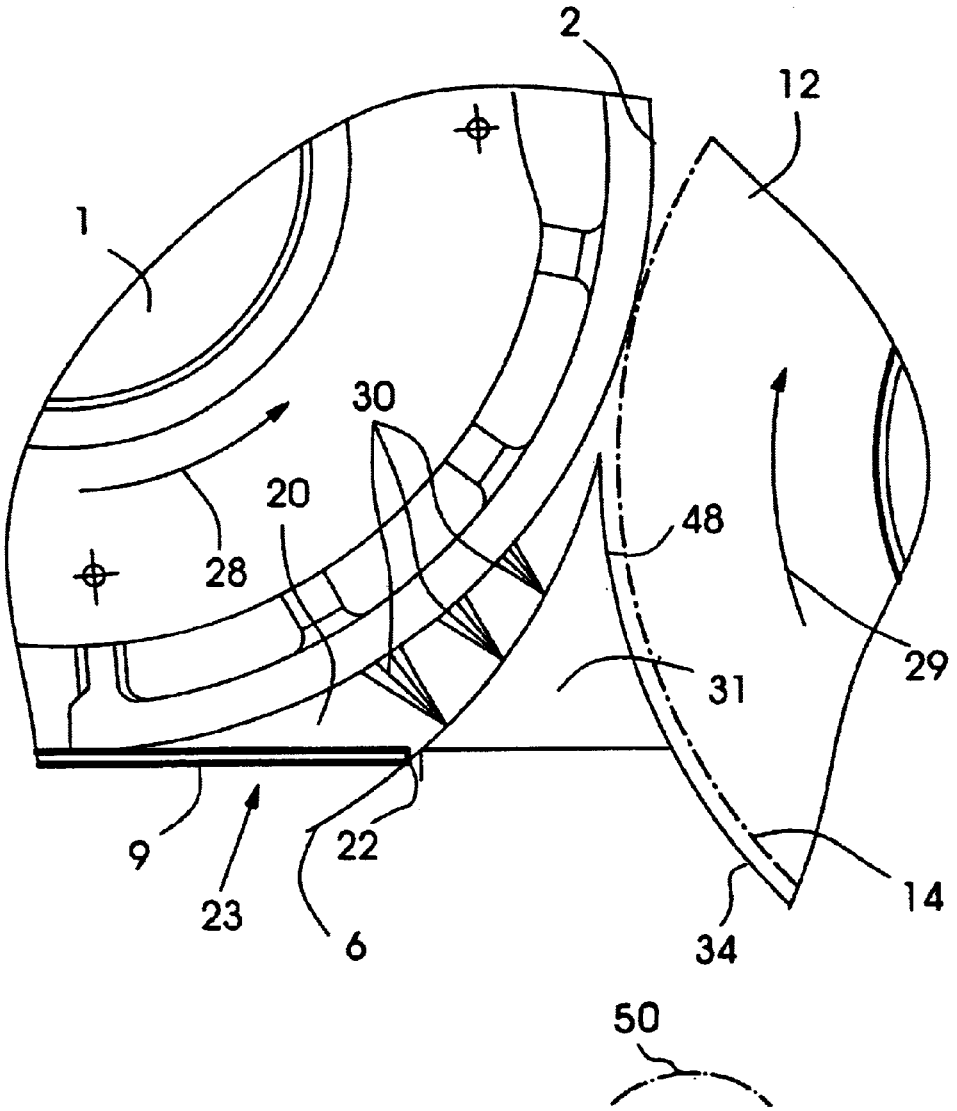
FIG. 7 is a partial, diagrammatic sectional view of a cylinder configuration with an additional guide element which faces a cylinder gusset in accordance with the invention.

Finally, in the illustration according to FIG. 7, a throw-on device 31 is illustrated, which acts contactlessly and, on its side facing the outer surface 2 of the impression cylinder 1, generates throw-on forces through the use of emerging free jets 30. The contactlessly acting throw-on device 31 is configured triangularly and is part of a guide device 34 thus forming a guide system 48, the guide device 34 being assigned to the preceding transfer cylinder 12 and is part of the storage or guide device 6 below the impression cylinder 1. Reference numeral 50 schematically indicates a further impression cylinder. The illustration according to FIG. 7 reveals the tendency of the sheet-like material 9 to assume a stretched position 23 as a result of the flexural rigidity. This tendency is counteracted through the use of the free jets 30. After the rear region of the relatively flexurally rigid sheet-like material 9 has been picked up, the latter is pressed with the unprinted side onto the outer surface 2 by the free jets 30. The opening region 20 consequently disappears during the further rotation of the printing-unit cylinder 1 in the counterclockwise direction 28.

I claim:

1. A device for turning sheet material having a trailing edge, comprising:

an impression cylinder having an outer surface with a given curvature, said impression cylinder being configured to guide the sheet material received on said outer surface of said impression cylinder;

a first transfer cylinder preceding said impressing cylinder, said first transfer cylinder having an outer surface;

said impression cylinder and said first transfer cylinder defining a gusset region between said outer surface of said impression cylinder and said outer surface of said first transfer cylinder;

a second transfer cylinder following said impression cylinder, said second transfer cylinder being a turning drum for gripping the trailing edge of the sheet material; and a throw-on device provided in the gusset region, said throw-on device contactlessly acting on the sheet material and causing the sheet material to assume, instead of a stretched position, a curved position corresponding to said given curvature of said outer surface of said impression cylinder such that a part of the sheet material is disposed in the gusset region.

2. The device according to claim 1, wherein;

said impression cylinder defines a desired position for the sheet material on the outer surface of the impression cylinder, the sheet material has a trailing edge and a rear region located upstream of the trailing edge; and said throw-on device is disposed such that said throw-on device acts on the rear region of the sheet material and generates a force directed perpendicularly to the desired position of the sheet material on the outer surface of the impression cylinder.

3. The device according to claim 1, wherein said throw-on device has orifices formed therein, said orifices are configured to discharge a fluid for generating free jets having at least one flow component directed perpendicularly onto said outer surface of said impression cylinder.

4. The device according to claim 1, wherein said throw-on device is configured as a blowpipe disposed in the gusset region between said first transfer cylinder and said impression cylinder.

5. The device according to claim 4, wherein said blowpipe is positioned in a clearance between said outer surface of said first transfer cylinder and an edge of the sheet material when in the stretched position.

6. The device according to claim 1, including a sheet guide device assigned to said first transfer cylinder and said impression cylinder, said throw-on device being integrated into said sheet guide device.

7. The device according to claim 6, wherein:

said impression cylinder and said first transfer cylinder define a central transfer region therebetween at which the sheet material is passed from one of said impression cylinder and said first transfer cylinder to a respective other one of said impression cylinder and said first transfer cylinder; and said throw-on device has orifices formed therein, said orifices discharge a medium for generating a throw-on force such that a sheet edge of the sheet material is pressed into a bearing contact with said outer surface of said impression cylinder as far as below the central transfer region.

8. The device according to claim 1, wherein:

said impression cylinder and said first transfer cylinder define a central transfer region therebetween at which the sheet material is passed from one of said impression cylinder and said first transfer cylinder to a respective other one of said impression cylinder and said first transfer cylinder; and a sheet guide device extends, below said impression cylinder, from the central transfer region to a further impression cylinder, said throw-on device is assigned to said sheet guide device.

9. The device according to claim 8, wherein said sheet guide device has a given shape adapted to a shape of the sheet material when being precurved by said throw-on device.

10. The device according to claim 8, wherein said sheet guide device includes individual bar-shaped elements spaced from one another.

11. The device according to claim 8, wherein said sheet guide device is a continuous guide plate.

12. The device according to claim 1, wherein said throw-on device is adjustable within a format adjustment travel such that said throw-on device is adaptable to a given sheet format of a sheet material having a given flexural rigidity.

13. The device according to claim 1, wherein said throw-on device has an upper end with outlet orifices formed therein, said outlet orifices provide free jets for flushing separating air between the sheet material and a further sheet material in the gusset region.

14. The device according to claim 1, wherein said throw-on device has outlet orifices formed therein, said outlet orifices are provided on a side of said throw-on device facing said outer surface of said impression cylinder, said outlet orifices generate free jets, the free jets generate a holding force directed onto a rear region of the sheet material having a given flexural rigidity such that a curvature length gain is achieved.

15. The device according to claim 1, including a transmission cylinder provided adjacent to said impression cylinder for printing onto the sheet material.

16. The device according to claim 1, including a storage device for intermediately storing the sheet material disposed between said first transfer cylinder and said second transfer cylinder.

17. A printing unit, comprising:

a turning device for turning a sheet material having a trailing edge, said turning device including an impression cylinder having an outer surface with a given curvature, said impression cylinder being configured to guide the sheet material received on said outer surface of said impression cylinder, a first transfer cylinder preceding said impression cylinder, said first transfer cylinder having an outer surface, said impression cylinder and said first transfer cylinder defining a gusset region between said outer surface of said impression cylinder and said outer surface of said first transfer cylinder, a second transfer cylinder following said impression cylinder, said second transfer cylinder being a turning drum for gripping the trailing edge of the sheet material, and a contactlessly acting throw-on device provided in the gusset region, said throw-on device causing the sheet material to assume, instead of a stretched position, a curved position corresponding to said given curvature of said outer surface of said impression cylinder such that a part of the sheet material is disposed in the gusset region; and a transmission cylinder provided adjacent said impression cylinder for printing onto the sheet material.

18. A multicolor rotary printing press, comprising:

a turning device for turning a sheet material having a trailing edge from a printed side onto a side to be printed, said turning device including an impression cylinder having an outer surface with a given curvature, said impression cylinder being configured to guide the sheet material received on said outer surface of said impression cylinder, a first transfer cylinder preceding said impression cylinder, said first transfer cylinder having an outer surface, said impression cylinder and said first transfer cylinder defining a gusset region between said outer surface of said impression cylinder and said outer surface of said first transfer cylinder, a second transfer cylinder following said impression cylinder, said second transfer cylinder being a turning drum for gripping the trailing edge of the sheet material, and a contactlessly acting throw-on device provided in the gusset region, said throw-on device causing the sheet material to assume, instead of a stretched position, a curved position corresponding to said given curvature of said outer surface of said impression cylinder such that a part of the sheet material is disposed in the gusset region; and a transmission cylinder provided adjacent said impression cylinder for printing onto the sheet material.

* * * * *

UNITED STATES PATENT AND TRADEMARK OFFICE

CERTIFICATE OF CORRECTION

PATENT NO. : 6,722,277 B2
DATED : April 20, 2004
INVENTOR(S) : Günter Stephan

It is certified that error appears in the above-identified patent and that said Letters Patent is hereby corrected as shown below:

Title page,
Item [30], Foreign Application Priority Data, should read as follows:

-- Nov. 15, 2000 (DE) ……. 100 56 720.7 --

Signed and Sealed this

First Day of June, 2004

JON W. DUDAS
*Acting Director of the United States Patent and Trademark Office*